US005588386A

United States Patent [19]

Schilt

[11] Patent Number: 5,588,386

[45] Date of Patent: Dec. 31, 1996

[54] PORTABLE COLLAPSIBLE VENTILATOR

[76] Inventor: John A. Schilt, 2800 Robin La., Muskogee, Okla. 74403

[21] Appl. No.: 600,550

[22] Filed: Feb. 13, 1996

[51] Int. Cl.[6] ..... B63J 2/00

[52] U.S. Cl. ..... 114/211; 454/78

[58] Field of Search ..... 114/361, 211, 114/212, 177, 201 R; 135/101, 102, 103, 104, 114, 115; 454/2, 14, 37, 65, 64, 78, 81, 82

[56] References Cited

U.S. PATENT DOCUMENTS

| | | | |
|---|---|---|---|
| 222,111 | 11/1879 | Wilson . | |
| 3,757,664 | 9/1973 | Jalbert | 114/211 |
| 4,434,740 | 3/1984 | Childs | 114/177 |
| 4,759,271 | 7/1988 | Bliemeister | 98/37 |
| 5,022,339 | 6/1991 | Baskin | 114/211 |
| 5,327,846 | 7/1994 | Androus | 114/211 |

*Primary Examiner*—Stephen Avila
*Attorney, Agent, or Firm*—Head, Johnson & Kachigian

[57] ABSTRACT

A portable collapsible ventilator, with a fabric enclosure intended for mounting over a hatch or porthole opening on the deck or hull of marine craft or other similar enclosed spaces. The ventilator consists of a bonnet shaped fabric enclosure which is attached to an opening frame made up of two members hinged at one end. The open ends of the opening frame are held apart at approximately the width of the hatch opening and maintained at that distance by means of a rope or line secured at both ends. The opening frame is made of a resilient material such that when the hinged end is pushed down, the two segments of the opening frame bend outward forming an oval shape and when thus compressed the ventilator may be secured to the deck of the boat or surface of enclosure by means of a pair of lines extending from the hinged point to a retaining bar inserted through and secured under the hatch opening. Two supporting rods extending from the top of the opening frame each a distance form the hinged junction, extend to the rear of the hatch and maintain additional stability.

The entire assembly is collapsible into a small tubular shape where the various structural members align themself axially and the fabric enclosure and lines fold around the structural members.

5 Claims, 3 Drawing Sheets

PORTABLE COLLAPSIBLE VENTILATOR

BACKGROUND OF THE INVENTION

1. Field of the Invention

The present invention relates to an improved device for increasing the airflow into enclosed spaces equipped with small openings. Such conditions are most frequently found in the cabins or hulls of small craft where the only ventilating opening is a small hatch or a porthole. Similar limited ventilating conditions may be found on land vehicles such as truck mounted campers and other recreational vehicles and in various sheds, test equipment enclosures and the like.

Various types of wind-scoops or ventilators have heretofore been designed for use in marine vessels. Some are permanent and hence expensive or impractical for small craft. Of the portable or collapsible types, most require some kind of overhead attachment and are therefore impractical for small motor launches or land vehicles where a superstructure is not available.

The current invention overcomes the prior limitations by being totally attachable to the opening itself whether a hatch on deck or a porthole on the side of a vessel or it may likewise be attached to an opening of a recreational vehicle or other enclosure which has limited ventilation openings as designed.

A further advantage of the current invention is that it is readily portable and may be collapsed into a small size like an ordinary household umbrella for easy storage aboard a marine vessel or elsewhere. Previous collapsible design such as described by Childs in U.S. Pat. No. 4,434,740 requires a substantial space for storage, and does not allow for closing the hatch while installed and must be specifically sized for each hatch opening. A collapsible design described by Bliemister in U.S. Pat. No. 4,759,271 has other limitations in that it cannot be readily mounted in varying directions with respect to the hatch opening and is therefore limited in use depending on wind or vessel direction.

The present invention overcomes the shortcomings of prior design, and it provides a ventilating means which is more flexible in use, more economical to build, and more adaptable to variety of openings and may be used in both watercraft as well as land vehicles such as recreational vehicles or in fixed containment enclosures, anywhere where enhanced airflow may improve ventilation from existing openings.

SUMMARY OF THE INVENTION

The invention involves a device which may readily be attached to hatch openings of watercraft or to such craft port holes, which when installed provides a scoop or enhancement by which air flow, such as breezes, may be collected and caused to enter the craft's cabin or deck spaces to improve the ventilation therein.

The new device is collapsible and thus, readily stowable within the confines of small craft, is economical to produce, and is readily installed by one crew member. Its inherent structure provides flexibility for mounting over a variety of typical hatch openings even allowing for the closing of the hatch cover with the device installed.

Another object of the invention is to provide added flexibility of use on various openings by providing for length adjustable support members. The device's adaptability is further enhanced by the feasibility of constructing the device in different sizes when the range of adaptability is exceeded for a given size.

The device consists of a two segment flexible frame member, one end of each is attached to the other and the opposing end held together by a short length of line, which when installed is bent out in a bow or circular shape over the opening. The bow shape is maintained by attaching dual lines starting at the apex and extending downward and outward to a horizontal rod to which rod the two lines are attached. The rod is inserted into and held in place under the hatch opening. Extending rearward from the flexible frame member is a fabric hood or scoop which fills out in the prevailing breeze and causes the air to flow through the opening of the device to the back thereof and thence downward through the hatch opening into the vessel's hold or cabin. To keep the device stable, two support rods are provided which extend from two points equal distance from the apex of the flexible frame member downward and to the rear of said device. These support rods may be of fixed length or may be made of adjustable length such as by using concentric tubular rods that are expandable.

When de-installed the entire assembly may be folded into an umbrella shaped structure and stowed in a tubular shaped container.

BRIEF DESCRIPTION OF THE DRAWINGS

These and other objects and advantages of this invention and a better understanding of the principles and details of the invention will be evident from the following description taken in conjunction with the appended drawings, in which.

DETAILED DESCRIPTION OF THE PREFERRED EMBODIMENTS

Figure 1:
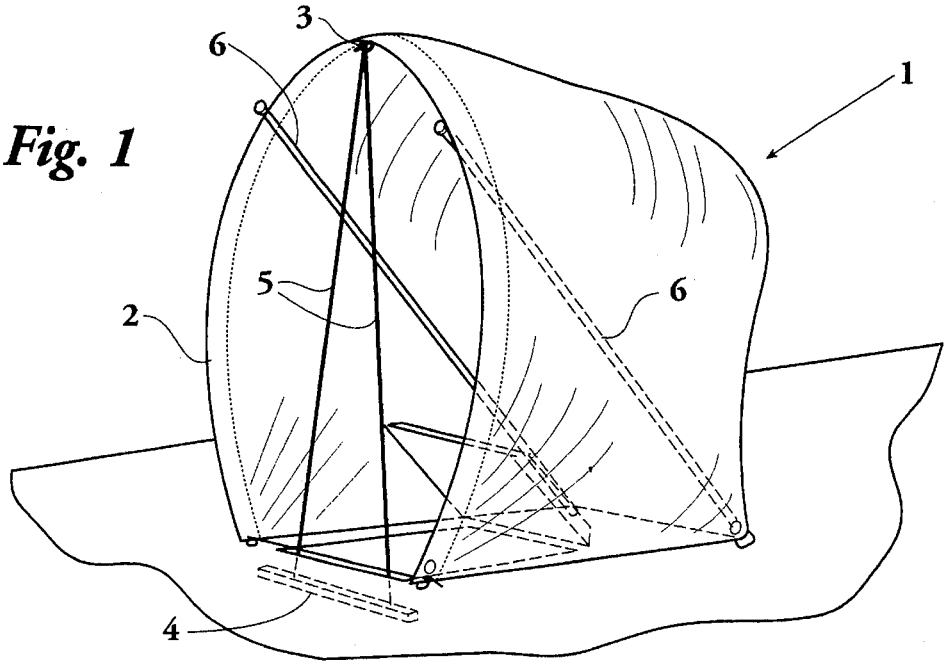
FIG. 1 is a perspective view of the device as assembled over a hatch opening.
Figure 2:
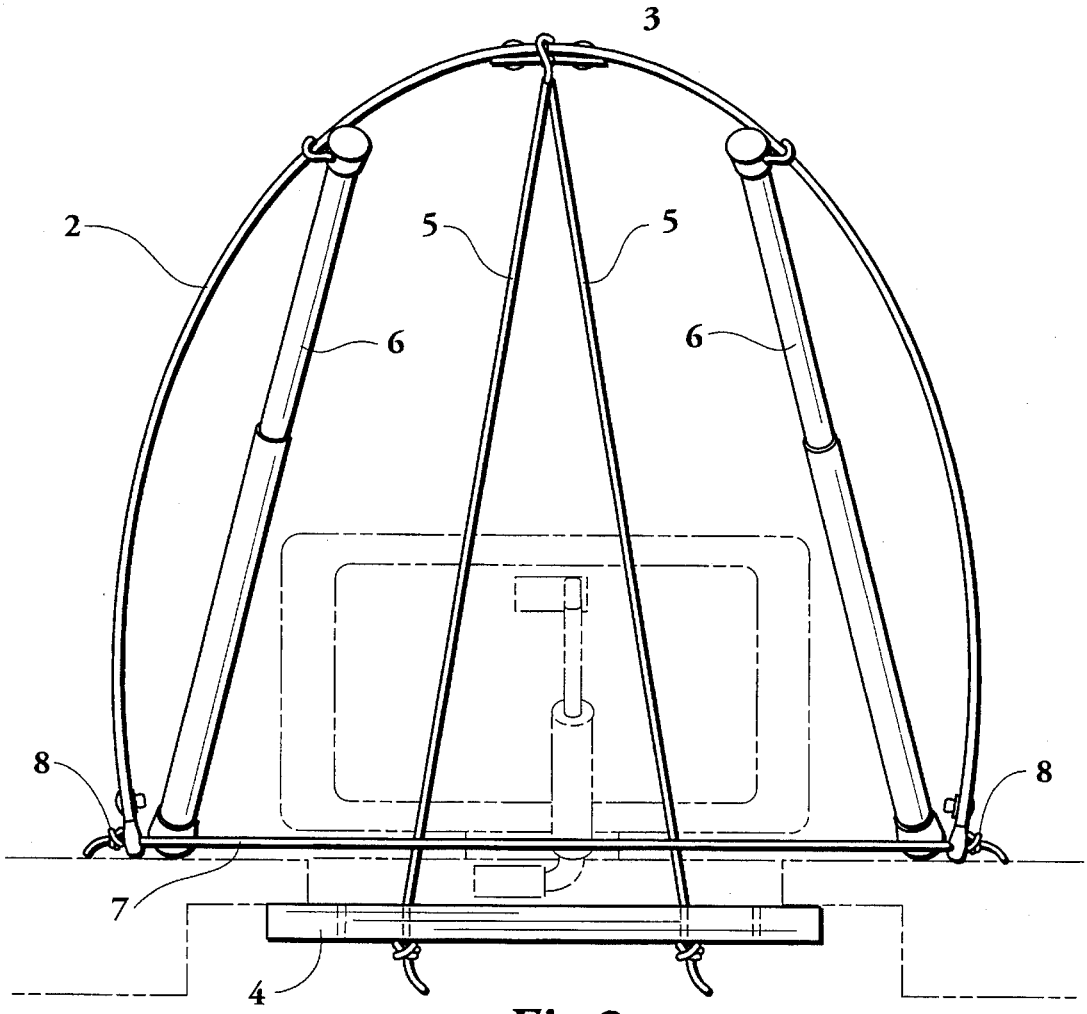
FIG. 2 is a frontal view of the device when installed over a hatch opening.

Referring now to FIG. 1 we see the invention as assembled over a hatch on the deck of a boat. The portable collapsible ventilator consists of a fabric enclosure 1, which is made to conform to the outer or opening frame 2 of the device which frame when installed assumes a semicircular or oval shape, said fabric enclosure extending inward or rearward to a somewhat smaller semicircular or oval shape forming the back or rear of the fabric enclosure. The fabric used is any light weight and preferably water resistant fabric that may be readily folded or compressed for storage without developing cracks or breaks.

Figure 3:
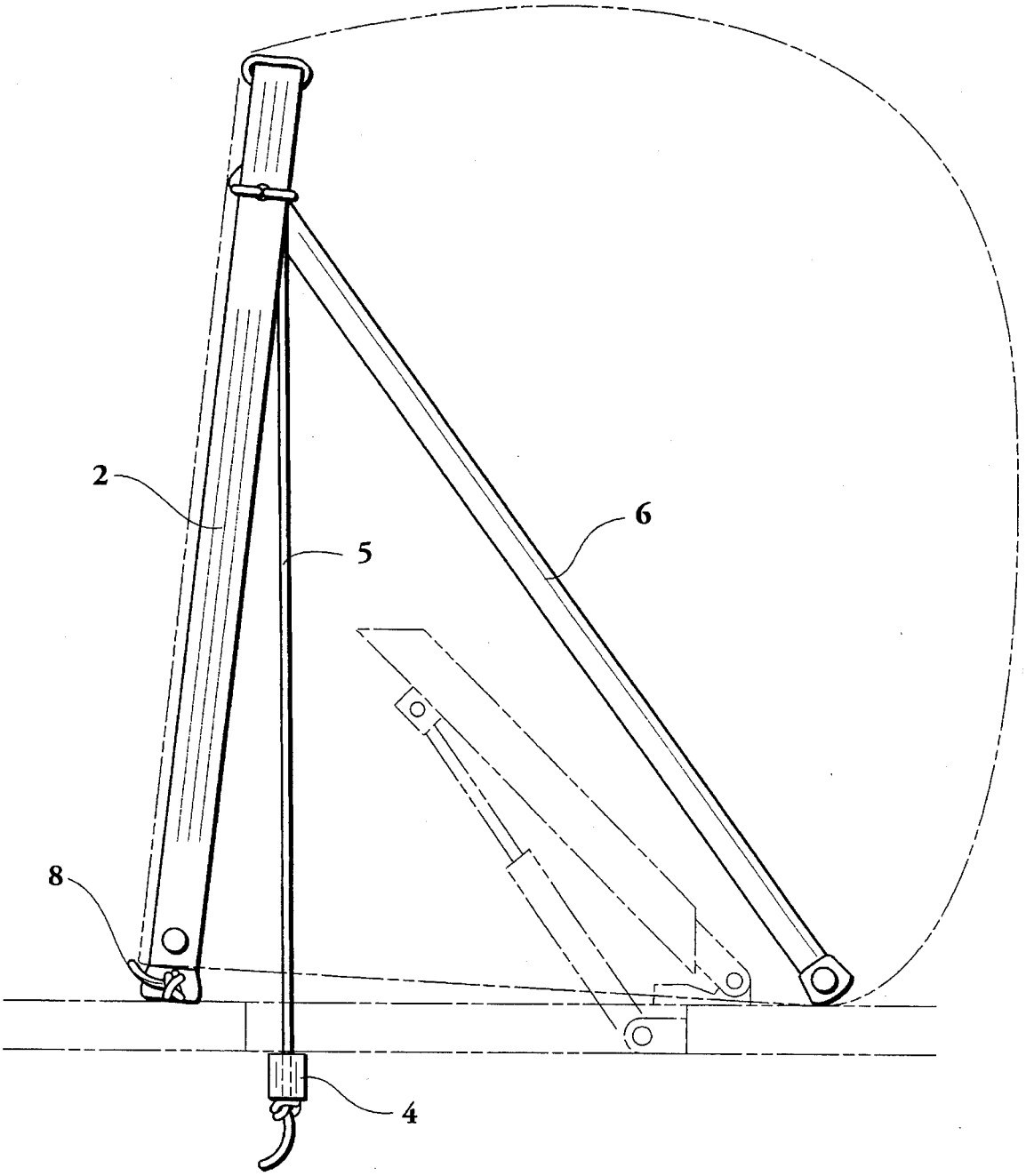
FIG. 3 is a side view of the device when installed over a hatch opening.

The fabric enclosure or wind scoop is attached to the outer or opening frame. The outer frame 2, is made of a resilient or flexible plastic, or other material and is hinged at the apex 3. The means for mounting the ventilator is to use the spring tension of the outer frame when compressed and hold the same in place by means of a retaining bar 4 shown in shadow on FIG. 1, which is inserted through the hatch opening and positioned under the hatch opening. Two lines 5, or ropes are tied between the apex 3 of the outer frame 2 and the retaining bar 4 at opposite ends of said retaining bar. The retaining bar is made of unfinished wood, to allow for customizing for various hatch openings where the portable collapsible ventilator might be used by the customer. A plurality of hole pairs are provided equal distance from the center of said retaining bar 4, to allow for placement of the securing lines 5, at the furthest width apart allowed by the size of the hatch opening without impinging against the sides of said opening. In order to provide for stability of mounting two support rods 6 are provided. These two rods are affixed to the top of the outer or opening frame as a distance from the apex thereof with means that allow each of the support rods to rotate about the point or junction with the outer or opening frame 2. The support rods are meant to be moved in assembly, to the rear corners of the enclosure as shown at 7 in FIGS. 1 and 3. The support rods may be made adjustable so that their length may be altered to suit the particular mounting characteristics. The tips or ends of the support rods as well as of the outer or opening frame are protected by plastic bumpers to avoid damage to the deck of the boat or surface of the enclosure on which the device is mounted.

Another line 7 extends from the ends of the outer or opening frame and is attached by means of knots 8 through holes provided therein. In this manner adjustments may be made to accommodate various hatch openings.

Figure 5:
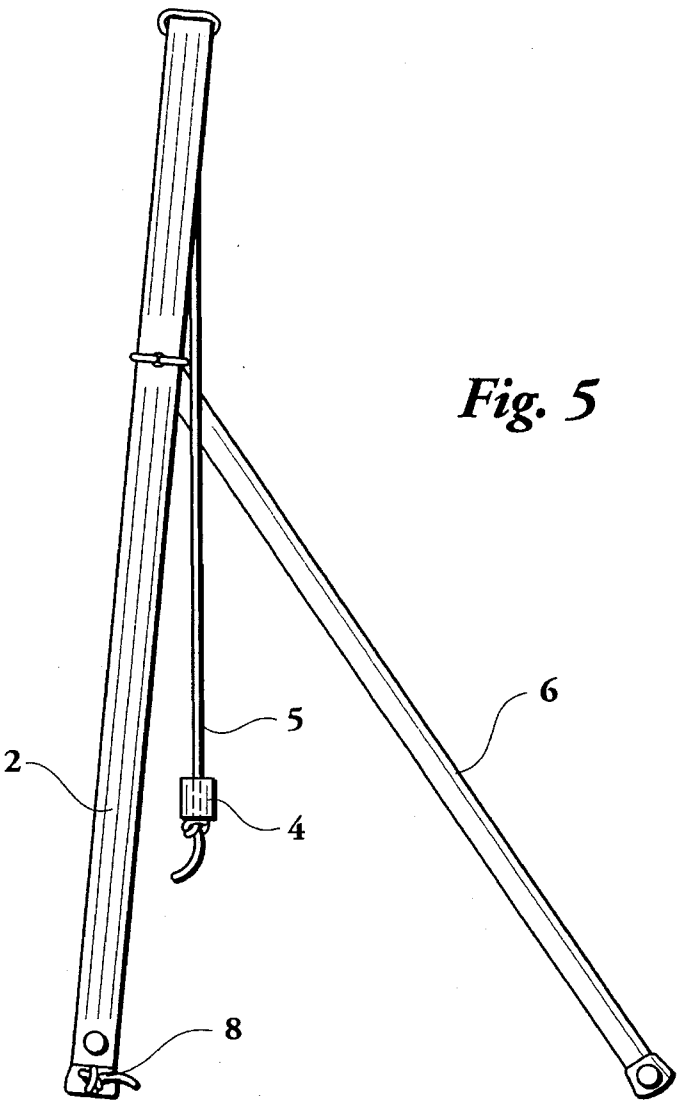
FIG. 5 is a side view of the device in a relaxed position.
Figure 4:
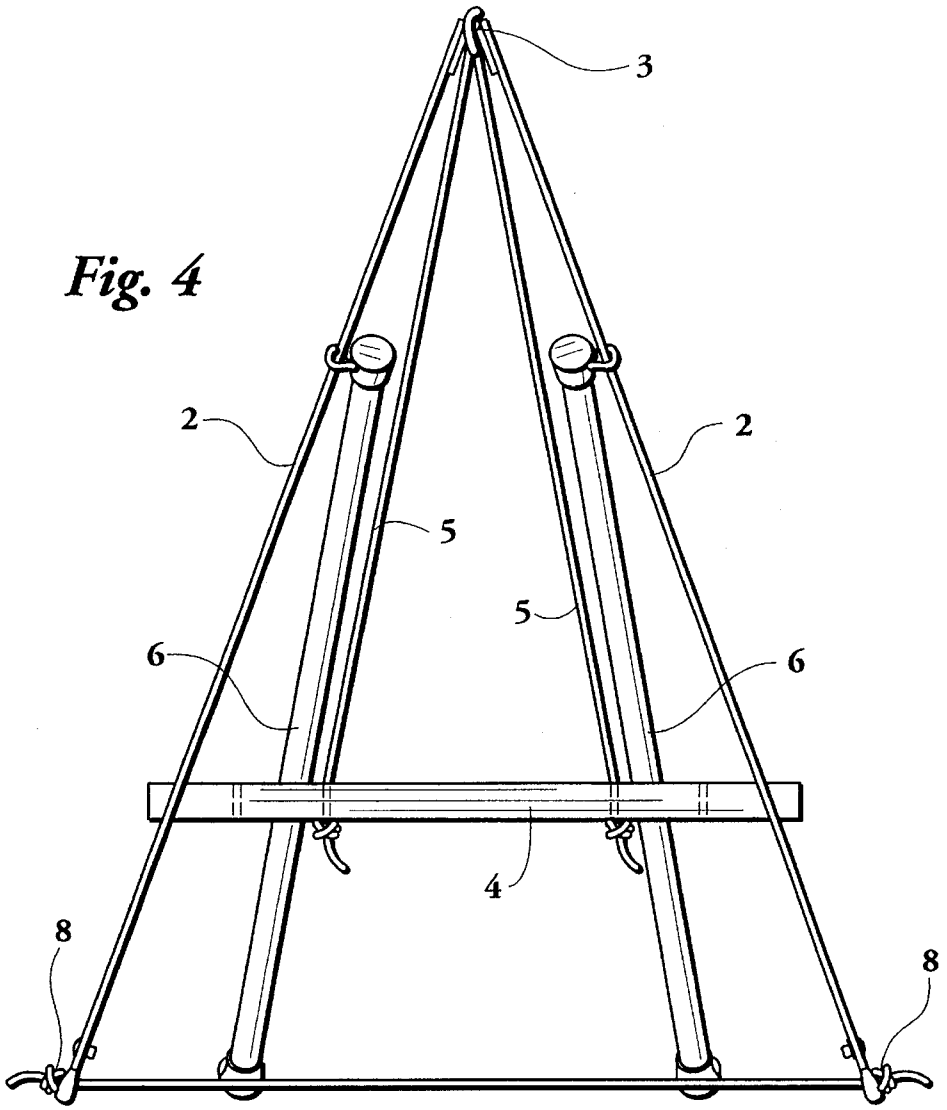
FIG. 4 is a view of the device in a relaxed position, showing how the device may be collapsed for storage.

FIG. 4 and FIG. 5 show the assembly in the relaxed mode either prior to installation or after de-installation. The fabric is not shown for clarity. The outer or opening frame forms two straight sections 2 joined at the apex, which fold together for storage such that their ends 8, meet. The two support frames 6, will similarly move together and align themselves with the two halves of the outer frame 2. The retaining rod may be rotated 90° to align with the other elements. The fabric cover, not shown in FIG. 4, and the lines, will collapse around the fixed elements e.g. the two halves of the outer frame, the two supporting rods and the retaining bar to form a compact whole which may be inserted in a fabric sheath or original shipping carton for easy storage.

For assembly, the portable collapsible ventilator is removed from its storage container and opened over an open hatch. The outer frame is oriented such that it faces the wind. The support rods naturally position themselves to the rear due to their attachment to the fabric at the bottom 7. By pushing down on the apex 3, the installer compresses the spring of the two halves of the outer frame forming a bow shape in each and a resulting semicircular shape for the entire opening. While holding the apex 3 down, the installer inserts the retaining rod vertically through the hatch and positions it horizontally below the hatch opening such that it holds the outer frame in spring tension and the entire ventilating assembly to the deck of the boat.

Whereas, the present invention has been described in relation to the drawings attached hereto, it should be understood that other and further modifications, apart from those shown or suggested herein, may be made within the spirit and scope of this invention.

What is claimed is:

1. A portable ventilating device adapted to deflect a stream of air into an opening of an enclosed space such as a boat hull, comprising:

a resilient frame joined at the apex, which is bendable into a semi-circular shape to form the ventilator opening;

an adjustable length of line tied to the opposite ends of said resilient frame and stretched between said ends forming the bottom of said ventilator opening;

two lengthwise tubular supporting members to provide support for said ventilator, the top of each of said tubular member being attached to said resilient frame away from said joint at the apex and extending from the front of said ventilator rearward to the bottom of each of said tubular member;

a securing rod designed to be of a size larger than the diameter or longer side of said opening of a boat hull or compartment, with a length of line, from said bar to a mounting point fixedly attached at the apex of said resilient frame said securing rod inserted inside said opening of a boat hull or compartment;

a cloth or fabric cover affixed to said resilient frame in the shape of a bonnet extending from said resilient frame outwardly and rearward and enclosing the above described structure; and said portable ventilating device thus securely affixed to said opening of a boat hull or compartment by means of the tension of said resilient frame and said supporting rod and said lines.

2. A portable ventilating device as described in claim 1 where said lengthwise tubular supporting members are adjustable such that each of their respective lengths may be extended or shortened.

3. A portable ventilating device as described in claim 2, where said securing rod is attached to the apex of said resilient frame by means of two lines extending from said apex to two points set apart on said securing rod away from the center of said securing rod.

4. A portable ventilating device as described in claim 3 where said securing rod is provided with a plurality of holes paired equidistant from the center of said securing rod through which said two securing lines may be attached.

5. A portable ventilating device as described in claim 1, where the ends of the resilient frame and the supporting rods are protected by non-abrasive coatings to prevent damage to the surface on which said device is mounted.

* * * * *